US008882443B2

(12) United States Patent
Agneray et al.

(10) Patent No.: US 8,882,443 B2
(45) Date of Patent: Nov. 11, 2014

(54) TURBOMACHINE COMPRESSOR WITH AN AIR INJECTION SYSTEM

(75) Inventors: Xavier Agneray, Veneux les Sablons (FR); Alexandre Chartoire, Paris (FR); Armel Touyeras, Combs la Ville (FR); Julien Loucheux, Draveil (FR)

(73) Assignee: SNECMA, Paris (FR)

( * ) Notice: Subject to any disclaimer, the term of this patent is extended or adjusted under 35 U.S.C. 154(b) by 860 days.

(21) Appl. No.: 12/995,376

(22) PCT Filed: May 28, 2009

(86) PCT No.: PCT/FR2009/050995
§ 371 (c)(1),
(2), (4) Date: Nov. 30, 2010

(87) PCT Pub. No.: WO2009/156645
PCT Pub. Date: Dec. 30, 2009

(65) Prior Publication Data

US 2011/0076133 A1 Mar. 31, 2011

(30) Foreign Application Priority Data

May 30, 2008 (FR) ..... 08 53553

(51) Int. Cl.
*F04D 27/02* (2006.01)
*F04D 29/68* (2006.01)

(52) U.S. Cl.
CPC ..... *F04D 27/0207* (2013.01); *F04D 29/681* (2013.01)
USPC ..... 415/57.1; 415/58.5; 415/59.1; 415/145

(58) Field of Classification Search
USPC ..... 415/144, 145, 115, 116, 57.1, 57.3, 415/58.4, 58.5, 58.7, 59.1, 57.4
See application file for complete search history.

(56) References Cited

U.S. PATENT DOCUMENTS

| | | | | |
|---|---|---|---|---|
| 5,586,859 | A * | 12/1996 | Nolcheff | 415/58.5 |
| 5,607,284 | A | 3/1997 | Byrne et al. | |
| 6,055,805 | A * | 5/2000 | El-Aini et al. | 60/226.1 |
| 2005/0129500 | A1 * | 6/2005 | Stangeland | 415/1 |
| 2006/0153673 | A1 * | 7/2006 | Guemmer | 415/115 |
| 2007/0217902 | A1 * | 9/2007 | Sirakov et al. | 415/58.4 |
| 2009/0232636 | A1 | 9/2009 | Grauer et al. | |

FOREIGN PATENT DOCUMENTS

| | | |
|---|---|---|
| DE | 10 2005 052466 | 5/2007 |
| EP | 0 719 908 | 7/1996 |
| GB | 479 427 | 1/1938 |

OTHER PUBLICATIONS

International Search Report issued Dec. 10, 2009 in PCT/FR09/050995 filed May 28, 2009.
U.S. Appl. No. 13/141,900, filed Jun. 23, 2011, Agneray, et al.

* cited by examiner

*Primary Examiner* — Christopher Verdier
(74) *Attorney, Agent, or Firm* — Oblon, Spivak, McClelland, Maier & Neustadt, L.L.P.

(57) ABSTRACT

A turbomachine or high pressure compressor including a stator casing housing a plurality of compression stages that are spaced apart in an axial direction along the central axis of the turbomachine, each compression stage including a row of rotor blades followed by a row of stator vanes. The compressor further includes an air injection system including at least one air injection passage through the casing and including an outlet segment that opens out in an inclined manner upstream from and directed towards a row of rotor blades into a set-back zone of the inside face of the casing.

16 Claims, 5 Drawing Sheets

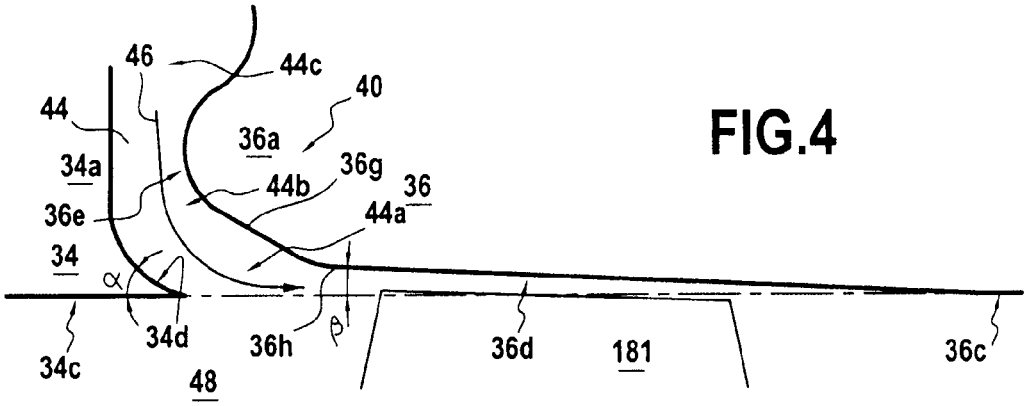
FIG.4
FIG.11
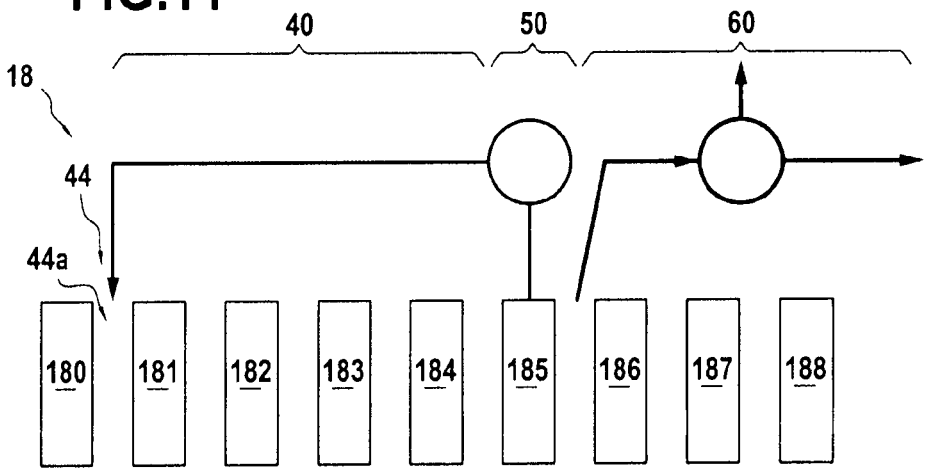

TURBOMACHINE COMPRESSOR WITH AN AIR INJECTION SYSTEM

BACKGROUND OF THE INVENTION

1. Field of the Invention

The invention relates to an aviation turbomachine compressor, in particular a turbojet compressor, and specifically a compressor for an airplane engine. The invention relates in particular to a high pressure (HP) compressor. It is most applicable to an axial compressor. The invention also relates to a turbomachine including such a compressor.

Such a compressor, in particular when it is a compressor of high pressure type, is a critical component of a turbomachine, since it determines the stability margins of the machine and since it is subjected to high mechanical loads at high temperatures.

2. Description of the Related Art

The HP compressor of a turbojet is made up of a plurality of successive compression stages. Each stage comprises a row or grid of rotor blades (a rotor wheel) and a row or grid of stator vanes (a stator wheel).

On passing through a grid of stator vanes (stator wheel), air is subjected to deflection that causes it to lose speed. Under such conditions, aerodynamic losses occur that are due to friction, which losses are also known as diffusion losses.

During operation of the engine, the clearance that exists between the rotor wheels and the stator casing surrounding the compressor constitutes a major technological effect limiting the performance of a high pressure compressor: it deteriorates the efficiency and operability of the compressor.

Friction losses and losses due to the clearance effect may become so severe as to generate air-flow separation, thereby giving rise to a "pumping" phenomenon that constitutes a limit on the operating range over which the compressor can be used. Any device that enables the stability range of the compressor to be extended enables the performance of the compressor to be increased.

Various approaches have been proposed for minimizing those phenomena that degrade the efficiency and the operating range of a turbomachine.

Commonly, air recirculation is established by bleeding air in register with (or immediately downstream from) the tips of a row of rotor blades and then reinjecting said air upstream from the tips of the same row of rotor blades. Such air recirculation generally passes via a cavity or passage defined in the stator casing. This applies to documents US 2005/0226717 and U.S. Pat. No. 5,474,417. Such air recirculation is sometimes associated with treatments applied to the casing, as in document EP 1 413 771. Nevertheless, various problems remain that are associated therewith, in particular significant disturbance to the air stream at the location where the recycled air is injected.

In document U.S. Pat. No. 7,077,623 B2, air recirculation is established between a plurality of successive compression stages via the insides of the airfoils and via the casing carrying the airfoils, firstly along the rows of stator vanes and secondly along the rows of rotor blades. That solution is complex to implement.

Documents DE 10 2005 052466, GB 504 214, EP 0 719 908, US 2005/0226717 and NL 45 457 all provide for an air injection system including at least one air injection passage having an outlet segment that opens out in inclined manner upstream from and towards a row of rotor blades.

BRIEF SUMMARY OF THE INVENTION

An object of the present invention is to propose a compressor service to reduce the impact of the clearance effect between the rotor blades and the casing on the performance and the operability of the compressor.

It is also desirable to provide a device that provides an overall improvement in performance for the propulsion system and that is readily incorporated in engine technology.

To this end, the present invention provides a turbomachine compressor comprising a stator casing housing a plurality of compression stages that are spaced apart in an axial direction along the central axis of the turbomachine, each compression stage comprising a row of rotor blades (rotor wheel) followed by a row of stator vanes (stator wheel), the compressor further including an air injection system comprising at least one air injection passage through the casing and having an outlet segment that opens out in inclined manner (angle alpha) upstream from and directed towards a row of rotor blades into a set-back zone ("trench") of the inside face of the casing, which set-back zone is in register with said row of rotor blades.

In this way, it can be understood that because of the shapes of the outlet segment and of the casing, and in particular because of the location of said outlet segment of the air injection passage in a set-back zone of the inside face of the casing that extends in register with a row of rotor blades and upstream therefrom, the air injection system makes it possible to inject air upstream from said row of rotor blades without significantly disturbing the air stream.

Such an air injection system enables the operating range of the compressor to be improved very significantly; the air injection system enables a small flow rate of air to be injected upstream from one of the rows of rotor blades, the air being directed downstream, which row of rotor blades is preferably, but not necessarily, the first rotor wheel of the compressor in the air flow direction, thus making it possible to limit the performance losses that are associated with clearance between the rotor wheel and the casing.

This solution also presents an additional advantage that stems from a specific disposition of the technology of a turbojet casing, of being suitable for being incorporated without significantly increasing the weight of the casing.

Preferably, from upstream to downstream, the stator casing comprises an intermediate casing and a rear casing that are connected to each other via annular flanges. The air injection passage is then defined between the annular flange of the rear casing and the annular flange of the intermediate casing.

In this way, by using the inter-flange zone as the location for the air injection passage, the invention can be implemented easily, either during initial manufacture, or else while adapting the compressor.

BRIEF DESCRIPTION OF THE SEVERAL VIEWS OF THE DRAWINGS

Other advantages and characteristics of the invention appear on reading the following description made by way of example and with reference to the accompanying drawings, in which:

FIG. 4 is a view analogous to the view of FIG. 3 showing a variant for the shape of the air injection passage;

FIG. 11 is a diagram showing one possible way of configuring the entire air injection system in a turbojet.

DETAILED DESCRIPTION OF THE INVENTION

Figure 1:
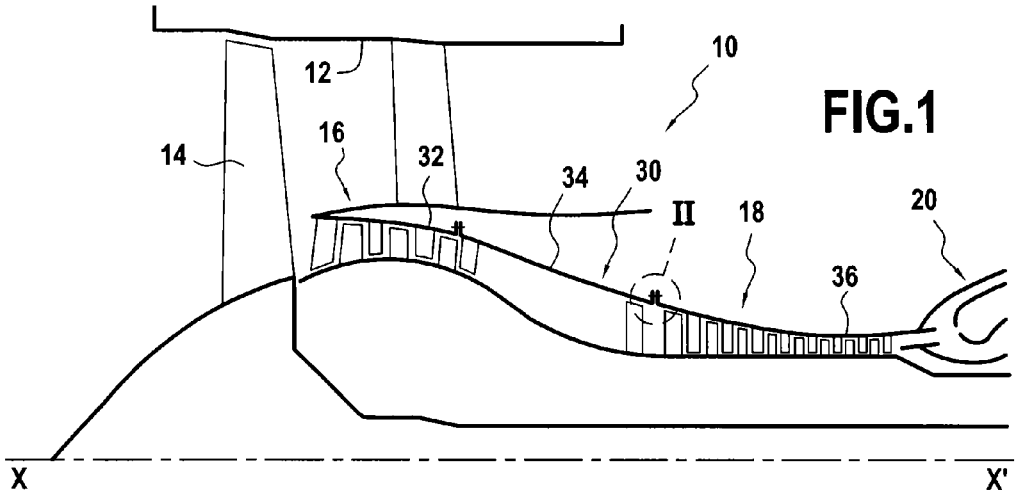
FIG. 1 is a diagrammatic fragmentary axial section view of a turbojet including a compressor in accordance with the invention.
Figure 2:
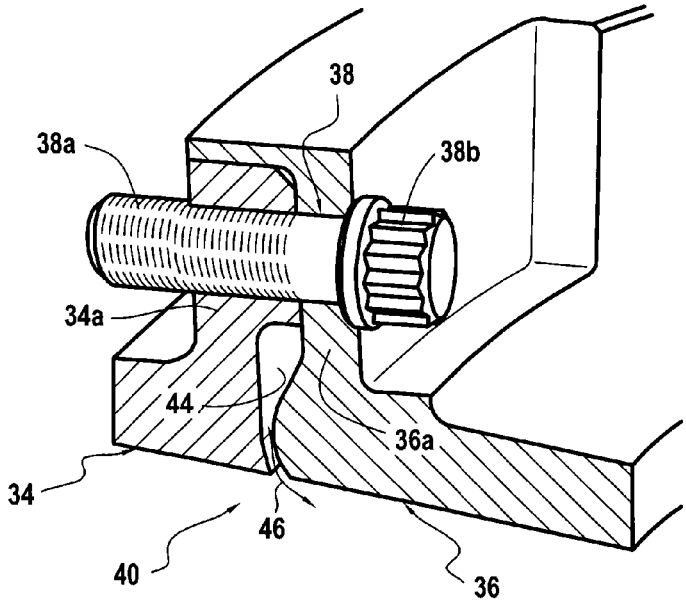
FIG. 2 is a greatly enlarged fragmentary view in perspective of a detail II in FIG. 1 showing the air injection passage.

FIG. 1 is a fragmentary view of a turbojet 10 of axis X-X', the turbojet conventionally comprising a peripheral nacelle 12 (shown in part only) within which there are situated in succession from left to right in FIG. 1 (i.e. from upstream to downstream in the air flow direction, or from front to rear): the fan 14; a low pressure compressor 16; a high pressure compressor 18; and a combustion chamber 20 downstream from which there is a turbine (not shown).

The outer shell or stationary casing 30 of the low pressure compressor 16 and of the high pressure compressor 18 is made up of three casing portions connected together in pairs by annular flanges: a front casing 32 surrounding the low pressure compressor 16; an intermediate casing 34; and a rear casing 36 surrounding the high pressure compressor 18.

With reference to FIGS. 2 to 8, there can be seen more precisely the arrangement of the invention made between the two annular flanges 34*a* and 36*a* connecting together the intermediate casing 34 and the rear casing 36 via a bolted connection 38 (tapped bores 341 and 361 in the flanges 34*a*, 36*a* connected by bolts each presenting a shank 38*a* and a head 38*b*).

The air injection system 40 includes air feed means 42 in the form of a pipe 42*a* and a threaded coupling 42*b* mounted on an opening 36*b* passing through the flange 36*a*, thereby feeding air to one or more air injection passages 44 leading to the main flow passage 48, these air injection passages 44 being made between the flanges 34*a* and 36*a* and opening out into the inside face of the casing 30 upstream from a row of rotor blades.

FIGS. 2 to 8 show a casing portion 30 presenting a single annular air injection passage 44 connected to the air feed pipe 42*a* via a single threaded coupling 42*b*.

Figure 9:
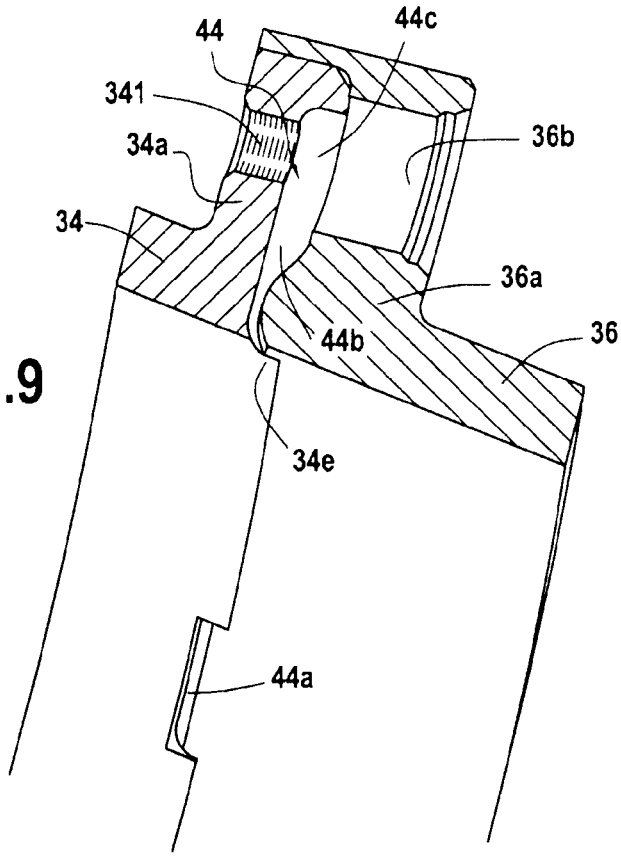
FIGS. 9 and 10 are fragmentary perspective views of the air injection system in a third embodiment, specifically a set of transverse slots distributed around the circumference.

FIG. 9 shows a variant in which the air injection system 40 has a plurality of air injection passages 44 regularly spaced around the circumference of the inside face of the casing 30 between the flanges 34*a*, 36*a*: in FIG. 9, there can be seen only the outlet (outlet segment 44*a*) of one of these multiple separate air injection passages 44.

Figure 8:
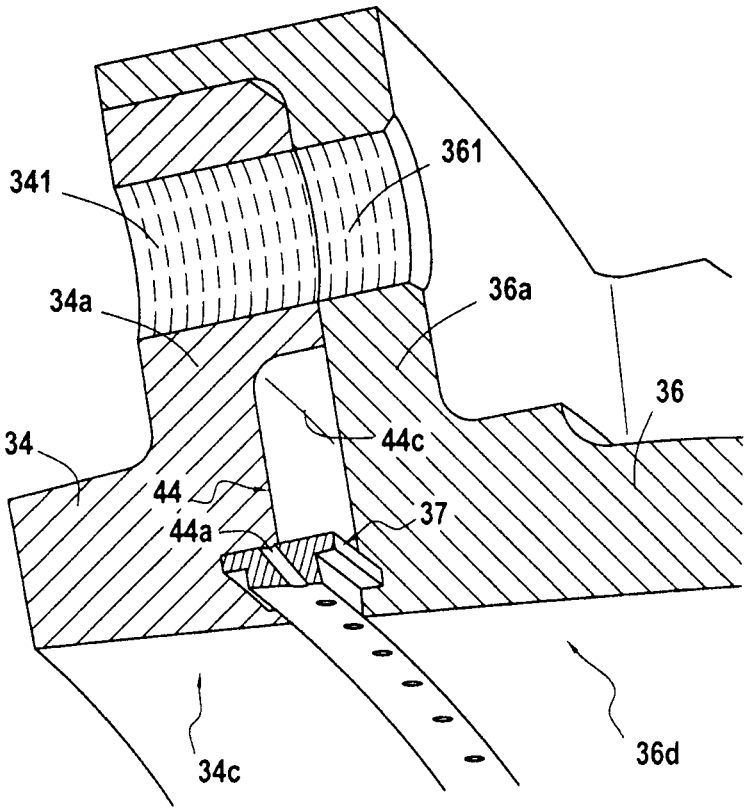
FIG. 8 is a view analogous to the view of FIG. 7 showing a variant of the second embodiment, specifically a row of injectors (holes or small slots) disposed in an additional part mounted between the intermediate casing and the rear casing of the high pressure compressor.

In FIG. 9, the outlet segment 44*a* is constituted by a slot, as in FIG. 8.

Each air injection passage 44 is connected by a threaded coupling to the air feed means 42. The exact number and distribution of air injection passage(s) 44 depend on the size of the engine and on installation constraints.

Thus, by its location, the annular air injection passage 44 is very easily obtained (in particular on a lathe) by machining the faces of the flanges 34*a* and 36*a* that are to come into contact against each other on assembly of the casing 30, and by machining the setback zone 36*d* if it is not already present. In particular, it should be observed that as a result of this inter-flange positioning, the air injection passage(s) 44 may be provided in equipment that already exists.

Figure 3:
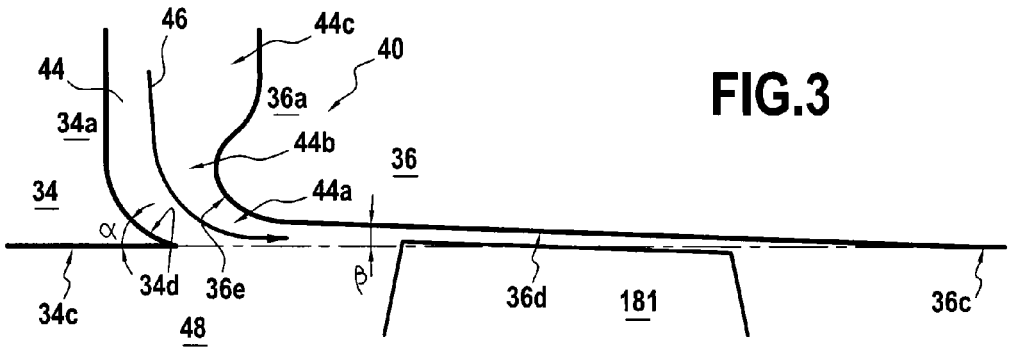
FIG. 3 is a diagrammatic view showing the positioning of the air injection passage relative to the row of moving blades that is treated.
Figure 5:
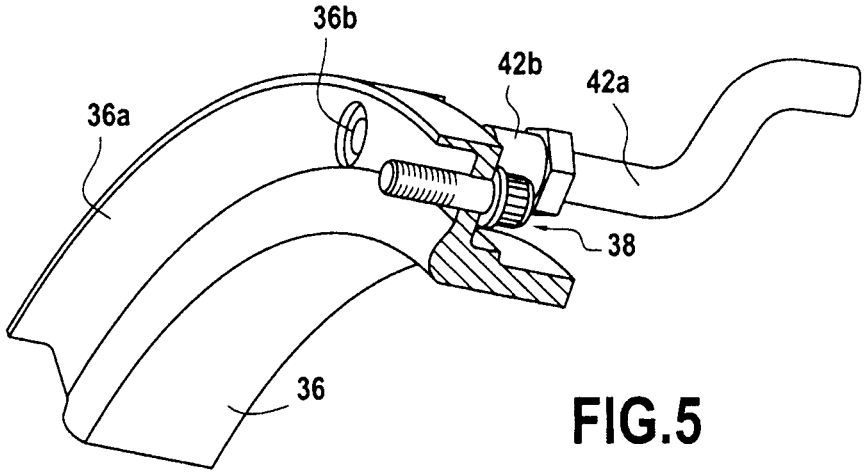
FIGS. 5 and 6 are fragmentary perspective views of parts belonging to the air injection system in a first embodiment, specifically a circumferential air injection slot defined between the intermediate casing and the rear casing of the high pressure compressor.
Figure 6:
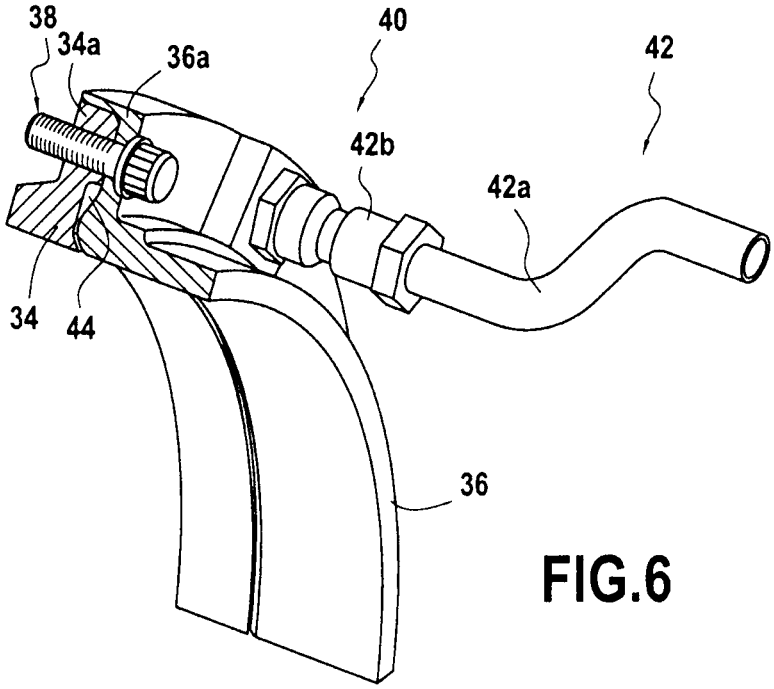

With reference to FIG. 3 that shows the shape of the air injection passage 44 in axial section containing the axis X-X' of the turbojet, it can be seen that this shape enables the air stream (arrow 46) to penetrate from the air injection passage 44 upstream from and going towards a row of rotor blades 181 in a manner that is inclined and tangential relative to the inside face 36*c* of the compressor casing 36.

More precisely, it can be seen that the air injection passage 44 comprises:

- a radially-directed upstream segment 44*c*; and
- an outlet segment 44*a* that opens out in inclined manner into the main flow passage 48: this outlet segment 44*a* forms an acute angle $\alpha$ relative to the inside face 34*c* of the intermediate casing 34, where $\alpha$ lies in the range 0° to 45°, and preferably in the range 10° to 20°, and more particularly is about 15°, and where said inside face 34*c* is the face of the casing that is situated upstream from (in front of) the air injection system 40.

In addition, in axial section this outlet segment 44*a* presents a progressively curved shape that is convex on the downstream side (rear casing 36) and concave on the upstream side (intermediate casing 34), making use of a projection 36*e* that runs tangentially into a set-back zone 36*d* (also known as a "trench") of the inside face 36*c* of the rear casing 36.

This set-back zone 36*d* forms a small acute angle $\beta$ relative to the inside face 34*c* of the intermediate casing 34 and relative to the inside face 36*c* of the rear casing 36 lying outside the set-back zone 36*d* that is in register with the row of rotor blades 181, such that the set-back zone 36*d* connects progressively with the inside face 36*c* of the rear casing 36, downstream from the corresponding row of rotor blades 181.

In the present invention, the term "set-back zone 36*d* in register with said row of rotor blades 181" covers only circumstances in which said set-back zone is defined directly by the inside face 36*c* of the rear casing 36.

Conventionally, such a set-back zone 36*d* serves to improve performance by minimizing the disturbance that corresponds to the clearance turbulence in the main stream. In the present example, the setback from the main flow passage 48 also serves to optimize positioning the injector and to ensure that injection takes place at an optimized angle $\alpha$ (lying in the range 0° to 45°, preferably in the range 10° to 20°, and in particular equal to about 15°).

In a variant embodiment shown in FIG. 4, the set-back zone 36*d* is connected to the projection 36*e* of the air injection passage 44 via the inside face 36*c* of the rear casing 36, not via a curved wall as shown in FIG. 3, but via a wall 36*g*, 36*h* presenting two slopes. This shape enables the air injection system 40 to be positioned so as to be sufficiently grazing relative to the main flow passage 48, even when the flange 34*a* of the intermediate casing 34 is not situated far enough upstream from the first rotor wheel 181.

The air injection passage 44 also includes a segment 44*b* of section that is narrower than that of the upstream segment 44*c*, the segment 44*c* being situated upstream from the outlet segment 44*a*, between the upstream segment 44*c* and the outlet segment 44*a*: it is the particular shape of the projection 36*e* formed on the face of the flange 36*a* that faces towards the intermediate casing 34 that makes it possible to provide this section that is smaller than the section of the upstream segment 44*c* of the air injection passage 44.

Overall, the outlet segment 44*a* forms a curve from the upstream segment 44*c* of the air injection passage 44 that extends radially towards the main flow passage 48 that extends axially, the inside face of the air injection passage 44 forming a fillet 34*d* beside the intermediate casing 34 and a projection 36*e* beside the rear casing 36.

Because of the segment 44*b* of narrower section, the air stream is accelerated to a speed that may be as much as 0.8 Mach to 1.2 Mach, i.e. a transonic flow is provided.

In this way, a small flow rate of air is directionally injected at high speed upstream from the tips of the rotor blades, thereby limiting loss of compressor performance associated with pressure losses induced by the clearance effect between the rotor blades and the casing.

In the first embodiment shown in FIGS. 2 to 6, the outlet segment 44*a* is in the form of an axially symmetrical annular slot. This embodiment may be conserved for installing partial slots that are distributed around the circumference and that are spaced apart from one another so as to replace the annular slot, as in the third embodiment shown in FIGS. 9 and 10.

Figure 7:
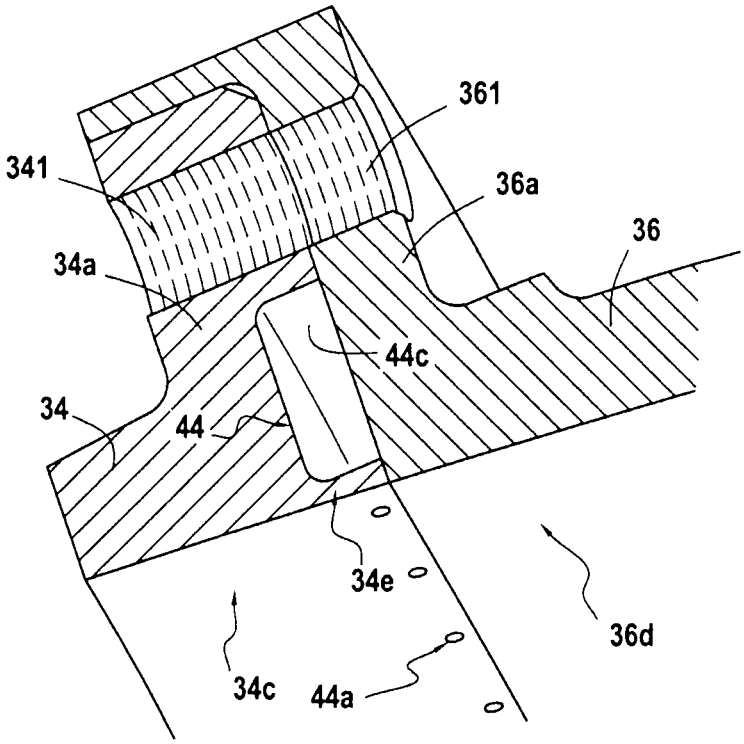
FIG. 7 is a fragmentary perspective view of an air injection system in a second embodiment of the invention, specifically a row of discrete injectors machined directly in the intermediate casing.

Alternatively, in a second embodiment, as shown in FIG. 7, the outlet segment 44*a* is formed by a series of orifices distributed along the annular surface of the casing 34.

Under such circumstances, the orifices constitute the outlet segment 44*a* that radially extend the annular upstream segment 44*c* of the air injection passage 44, and they are formed in the annular end of an axial flange 34*e* of the intermediate casing 34.

In a variant of this second embodiment, as shown in FIG. 8, the axial flange 34*e* is replaced by a separate part constituting a spacer 37 that is machined separately and that is fitted between the intermediate casing 34 and the rear casing 36, this spacer 37 being pierced by orifices or small inclined slots that constitute the outlet segments 44*a* of the air injection passage 44. Thus, the spacer 37 forms a separate part that is easier to replace than changing both the intermediate casing 34 and the rear casing 36.

Figure 10:
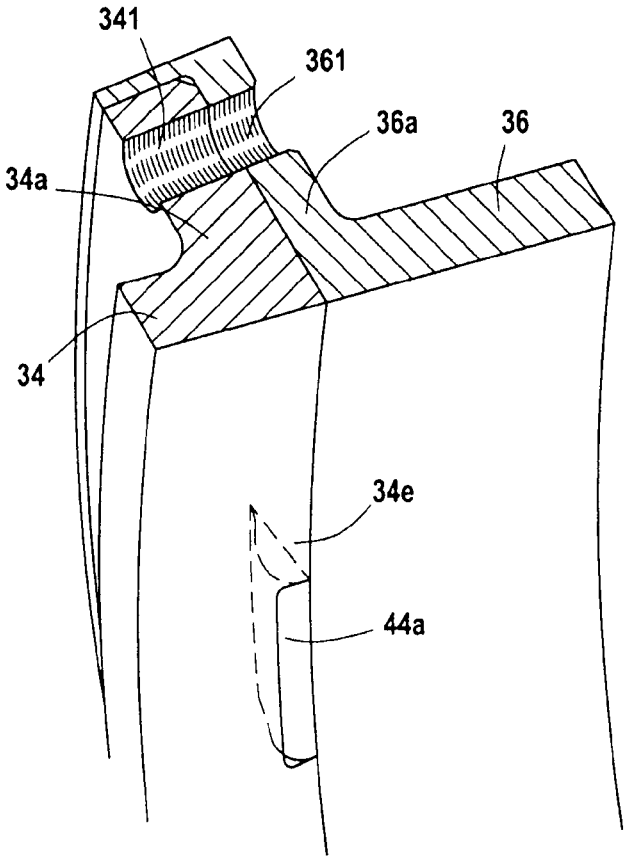

In a third embodiment of the invention shown in FIGS. 9 and 10, the outlet segment 44*a* of the air injection passage 44 is made up of transverse slots that are distributed annularly and that are put into place by special machining of the flange 34*e*.

Preferably, the outlet segment 44*a* of the air injection passage 44 opens out upstream from the first row of rotor blades 181 (see FIGS. 1 and 9), downstream from the inlet guide vanes (IGV) 180.

Nevertheless, it is possible to place the air injection passage 44 upstream from any one or more of the row(s) of rotor blades selected from the rows of rotor blades 181, 183, 185, and 187, which rows are interposed between rows of stator vanes 182, 184, 186, and 188.

The air injection system 40 is associated with an air bleed system 50 (see FIG. 11). For this purpose, the air injection system is fed with air by an air bleed system opening out in register with a row of rotor blades situated downstream from the row of rotor blades in front of which the air injection passage 44 is located.

Advantageously, the air bleed system 50 feeding the air injection system 40 of the invention is provided in register with the second row of rotor blades situated downstream from the row of rotor blades in front of which the air injection passage 44 is located.

This applies in the example of FIG. 11 where the outlet segment 44*a* of the air injection passage 44 opens out upstream from the first row of rotor blades 181 and the air bleed system 50 is fed in register with the third row of rotor blades 185. An implementation of such a configuration has been found to reduce the specific fuel consumption of the engine.

It should be observed that by means of the air bleed system 50 and the air injection system 40, automatically-fed air circulation is established as a result solely of the pressure difference between the location in the main flow section 48 from which air is bled and the location along the main flow passage 48 at which air is injected.

FIG. 11 also shows in diagrammatic manner a conventional air bleed system 60 taking air downstream from the third row of rotor blades 185 for use in the high pressure turbine and/or other portions of the engine that needs to be ventilated and/or inside the airplane (in particular inside the cabin).

It can be understood that the size of the section of the outlet segment 44*a* (regardless of whether it is a circumferential slot or a row of orifices) is the main feature determining the outlet flow rate of the injected air.

Optionally, provision may be made for the air injection system 40 also to include regulator means (not shown) for regulating the flow rate of air penetrating into the air injection passage 44 and enabling the air injection system to be activated or not activated as a function of the operating conditions of the high pressure compressor.

It should be observed that the high pressure compressor 18 fitted with the injection system 40 and the air bleed system 50 in accordance with the invention and as described above improves the specific fuel consumption of the engine by recycling air inside a single compressor. Devices for taking air from a rotor stage and for reinjecting it serve to improve performance by an amount that is greater than the losses inherent to the recycling circuit.

The invention claimed is:

1. A turbomachine compressor comprising:

a stator casing housing a plurality of compression stages that are spaced apart in an axial direction along the central axis of the turbomachine compressor, each compression stage comprising a row of rotor blades followed by a row of stator vanes; and an air injection system comprising at least one air injection passage through the stator casing and including an outlet segment that opens out in an inclined manner upstream from and directed towards a row of rotor blades into a set-back zone of an inside face of the casing, which set-back zone is in register with the row of rotor blades, wherein the set-back zone presents an acute angle relative to an inside face of an intermediate casing of the stator casing and relative to an inside face of a rear casing of the stator casing lying outside the set-back zone that is in register with the row of rotor blades.

2. A compressor according to claim 1, wherein the outlet segment forms a bend.

3. A compressor according to claim 1, wherein the air injection passage presents a segment of narrow section upstream from the outlet segment.

4. A compressor according to claim 1, wherein the outlet segment opens out upstream from the first row of rotor blades of the compressor in the air flow direction.

5. A compressor according to claim 1, wherein the outlet segment forms an acute angle relative to a portion of the inside face of the casing which is situated upstream from the air injection system.

6. A compressor according to claim 1, wherein the air injection passage is annular.

7. A compressor according to claim 6, wherein the outlet segment includes an annular slot.

8. A compressor according to claim 7, wherein the outlet segment includes a series of orifices distributed along the annular surface of the stator casing.

9. A compressor according to claim 1, wherein the air injection system is fed with air by an air bleed system opening out in register with a second row of rotor blades situated downstream from the row of rotor blades in front of which the air injection passage is located.

10. A compressor according to claim 9, wherein the air is bled off in register with the second row of rotor blades situated downstream from the row of rotor blades in front of which the injection passage is located.

11. A compressor according to claim 1, wherein the air injection system further includes a regulator which regulates the flow rate of air penetrating into the air injection passage.

12. A compressor according to claim 1, constituting a high pressure compressor.

13. A compressor according to claim 12, wherein the stator casing comprises, from upstream to downstream, the intermediate casing and the rear casing connected together by annular flanges, and wherein the air injection passage is defined between the annular flange of the rear casing and the annular flange of the intermediate casing.

14. A compressor according to claim 1, wherein the at least one air injection passage further includes a radially directed upstream segment which is provided upstream of the outlet segment.

15. A turbomachine including a compressor, the compressor comprising:

a stator casing housing a plurality of compression stages that are spaced apart in an axial direction along the central axis of the turbomachine compressor, each compression stage comprising a row of rotor blades followed by a row of stator vanes; and an air injection system comprising at least one air injection passage through the stator casing and including an outlet segment that opens out in an inclined manner upstream from and directed towards a row of rotor blades into a set-back zone of an inside face of the casing, which set-back zone is in register with the row of rotor blades, wherein the set-back zone presents an acute angle relative to an inside face of an intermediate casing of the stator casing and relative to an inside face of a rear casing of the stator casing lying outside the set-back zone that is in register with the row of rotor blades.

16. A turbomachine compressor comprising:

a stator casing housing a plurality of compression stages that are spaced apart in an axial direction along the central axis of the turbomachine compressor, each compression stage comprising a row of rotor blades followed by a row of stator vanes; and an air injection system comprising at least one air injection passage through the stator casing and including an outlet segment that opens out in an inclined manner upstream from and directed towards a row of rotor blades into a set-back zone of an inside face of the casing, which set-back zone is in register with the row of rotor blades, wherein, in axial section, the outlet segment presents a progressively curved shape which is convex on a downstream side and concave on an upstream side, and a projection is provided in the casing which is tangential to the set-back zone.

* * * * *